US007171950B2

(12) United States Patent
Palma et al.

(10) Patent No.: US 7,171,950 B2
(45) Date of Patent: Feb. 6, 2007

(54) METHOD AND DEVICE FOR DETERMINING THE PRESSURE IN THE COMBUSTION CHAMBER OF AN INTERNAL COMBUSTION ENGINE, IN PARTICULAR A SPONTANEOUS IGNITION ENGINE, FOR CONTROLLING FUEL INJECTION IN THE ENGINE

(75) Inventors: Giuseppe Palma, Napoli (IT); Olga Scognamiglio, Portici (IT); Mario Lavorgna, Bacoli (IT)

(73) Assignee: STMicroelectronics S.r.l., Agrate Brianza (IT)

( * ) Notice: Subject to any disclaimer, the term of this patent is extended or adjusted under 35 U.S.C. 154(b) by 107 days.

(21) Appl. No.: 10/842,845

(22) Filed: May 11, 2004

(65) Prior Publication Data

US 2005/0022789 A1 Feb. 3, 2005

(30) Foreign Application Priority Data

May 12, 2003 (EP) ..... 03425303

(51) Int. Cl.
*F02M 7/28* (2006.01)
*F02M 51/00* (2006.01)

(52) U.S. Cl. ..... 123/435; 123/480; 123/494; 73/118.1; 701/106

(58) Field of Classification Search ..... 123/299, 123/300, 435, 472, 494, 480; 701/103–105, 701/106; 73/118.2, 118.1
See application file for complete search history.

(56) References Cited

U.S. PATENT DOCUMENTS 4,903,665 A 2/1990 Washino et al. ..... 123/435
5,492,007 A * 2/1996 Noble et al. ..... 73/117.3
5,979,400 A * 11/1999 Nishide ..... 123/305
6,216,664 B1 * 4/2001 Bochum et al. ..... 123/305
6,508,227 B2 * 1/2003 Bochum ..... 123/295
6,684,151 B1 * 1/2004 Ring ..... 701/110
6,714,852 B1 * 3/2004 Lorenz et al. ..... 701/102
6,827,063 B2 * 12/2004 Breitegger et al. .... 123/406.58
6,840,218 B2 * 1/2005 Scholl et al. ..... 123/435
6,866,024 B2 * 3/2005 Rizzoni et al. ..... 123/430

(Continued)

FOREIGN PATENT DOCUMENTS

DE 199 27 846 A1 12/2000

(Continued)

OTHER PUBLICATIONS

Palma, G. et al., "Low Cost Virtual Pressure Sensor," *STMicroelectronics R& D*, Naples, Italy, 2003.

*Primary Examiner*—Hai Huynh
(74) *Attorney, Agent, or Firm*—Lisa K. Jorgenson; Dennis M. de Guzman; Seed IP Law Group PLLC

(57) ABSTRACT

A method is described for controlling fuel injection in an spontaneous ignition engine equipped with an electronically controlled fuel injection system and with an electronic control unit receiving engine quantities comprising the pressure in the combustion changer of the engine and closed-loop controlling the fuel injection system on the basis of the pressure in the combustion chamber, in which the pressure in the combustion chamber is determined as a function of engine kinematic quantities such as the engine speed and the crank angle and of the fuel injection law, which is defined by the quantity of fuel injected and by the crank angle at the start of injection.

35 Claims, 5 Drawing Sheets

U.S. PATENT DOCUMENTS

| | | | | |
|---|---|---|---|---|
| 6,925,373 | B2 * | 8/2005 | La Rosa et al. | 701/109 |
| 2002/0073940 | A1 * | 6/2002 | Simescu et al. | 123/25 C |
| 2003/0127073 | A1 * | 7/2003 | Buck et al. | 123/435 |
| 2004/0260482 | A1 * | 12/2004 | Tanaka et al. | 702/45 |
| 2005/0251322 | A1 * | 11/2005 | Wang et al. | 701/114 |

FOREIGN PATENT DOCUMENTS

| | | |
|---|---|---|
| JP | 5-222998 | 8/1993 |
| WO | WO 01/51808 A1 | 7/2001 |

* cited by examiner

METHOD AND DEVICE FOR DETERMINING THE PRESSURE IN THE COMBUSTION CHAMBER OF AN INTERNAL COMBUSTION ENGINE, IN PARTICULAR A SPONTANEOUS IGNITION ENGINE, FOR CONTROLLING FUEL INJECTION IN THE ENGINE

BACKGROUND OF THE INVENTION

1. Field of the Invention

The present invention concerns a method and a device for determining the pressure in the combustion chamber of an internal combustion engine, in particular a spontaneous ignition engine.

The present invention also concerns a method and a device for controlling fuel injection in an internal combustion engine, in particular a spontaneous ignition engine, using said method for determining the pressure in the combustion chamber.

2. Description of the Related Art

As is known, the cars currently on the market are equipped with a complex and sophisticated control system that is able to implement complex control strategies with the aim of optimizing, on the basis of information received from physical on-board sensors, certain important engine quantities such as consumption, exhaust emission levels, engine torque, and acoustic noise produced by the engine.

In general, the cost limits imposed by the automobile market on cars make it practically impossible to adopt closed-loop control strategies, which can be achieved only for research purposes in specially set-up laboratories, and allow only the adoption of open-loop control strategies operating on the basis of maps memorized in the electronic control unit and experimentally defined on the work-bench during the engine design phase, with all the consequences that may ensue from the absence of feedback, such as poor reliability and unsatisfactory performances.

The closed-loop control achieved in the laboratory operates on the basis of the pressure value in the combustion chamber, since all the above-mentioned engine quantities to be optimized can be derived from this, and the pressure value in the combustion chamber is measured by means of a dynamic pressure sensor arranged in the combustion chamber and able to follow the sudden pressure variations in the engine cycle.

FIG. 1 shows a schematic block diagram of a typical closed-loop control system used in a research laboratory. In particular, in FIG. 1 is indicated with 1 a Diesel engine equipped with an electronically controlled fuel injection system 2, that is a fuel injection system 2 of the type comprising one or more electro-injectors 3, each for injecting fuel in a respective cylinder of the engine under the control of an electronic control unit (ECU) 4. In this type of injection system, the instantaneous flow rate of fuel to be injected ROI ("Rate Of Injection") is adjusted by the electronic control unit 4 on the basis of reference values of engine quantities to be optimized, such as consumption, exhaust emission levels, engine torque, acoustic noise, all of which can be indirectly obtained from the pressure in the combustion chamber. In turn, the pressure in the combustion chamber is measured by means of a dynamic pressure sensor 5 arranged in the combustion chamber and generating a pressure signal which is then processed either by a dedicated electronic device 6, as shown in FIG. 1, or directly by the electronic control unit 4 in order to assess by how much the actual values of the quantities to be optimized differ from the reference values. This information is then used by the electronic control unit 4 to choose the most suitable injection law to be implemented in the next engine cycle to optimize the above-mentioned engine quantities.

However, the closed-loop control described above is applicable only in the laboratory on experimental prototypes and cannot at the moment be adopted on cars intended for the market due not only to the high cost of the dynamic pressure sensor but above all due to the numerous problems deriving from the use of the pressure sensor such as its bulk in the combustion chamber, the need for its periodic maintenance and replacement due to wear, since it is subject to the high pressures and temperatures present in the combustion chamber, replacement which, inter alia, would require an estimate of its average life cycle, and last but not least the need to provide a specific electronic device that manages it (an amplifier, a sophisticated filter, a current-voltage-pressure converter).

BRIEF SUMMARY OF THE INVENTION

The aim of the present invention is to provide a method and a device for determining the pressure in the combustion chamber and a device for controlling fuel injection in an internal combustion engine, in particular a spontaneous ignition engine, which make it possible to overcome the above-mentioned problems connected with the use of a dynamic pressure sensor, in particular which do not need a dynamic pressure sensor arranged in the combustion chamber and which at the same time present performances comparable with those that can be obtained with a dynamic pressure sensor.

According to the present invention a method and a device for determining the pressure in the combustion chamber of an internal combustion engine, in particular a spontaneous ignition engine, are provided.

According to the present invention a method and a device for controlling fuel injection in an internal combustion engine, in particular a spontaneous ignition engine, are also provided.

BRIEF DESCRIPTION OF THE DRAWINGS

For a better understanding of the present invention, a preferred embodiment is now described, purely as a non-limiting example, with reference to the enclosed drawings, in which.

DETAILED DESCRIPTION OF THE INVENTION

The idea underlying the present invention is providing a determining device actually constituting a virtual pressure sensor external to the combustion chamber, able to assess in real time the pressure in the combustion chamber, in the manner described below in detail, and to supply to the electronic control unit a pressure signal completely equivalent to the one supplied by a dynamic pressure sensor used in laboratory, and actually constituting a virtual feedback signal that can be directly used by the electronic control unit to closed-loop control the above-mentioned car quantities.

In this way it is actually possible to realize a closed-loop control system completely equivalent to that used in laboratory but without the need of a pressure sensor arranged in the combustion chamber, thus allowing its adoption on cars intended for the market.

Figure 1:
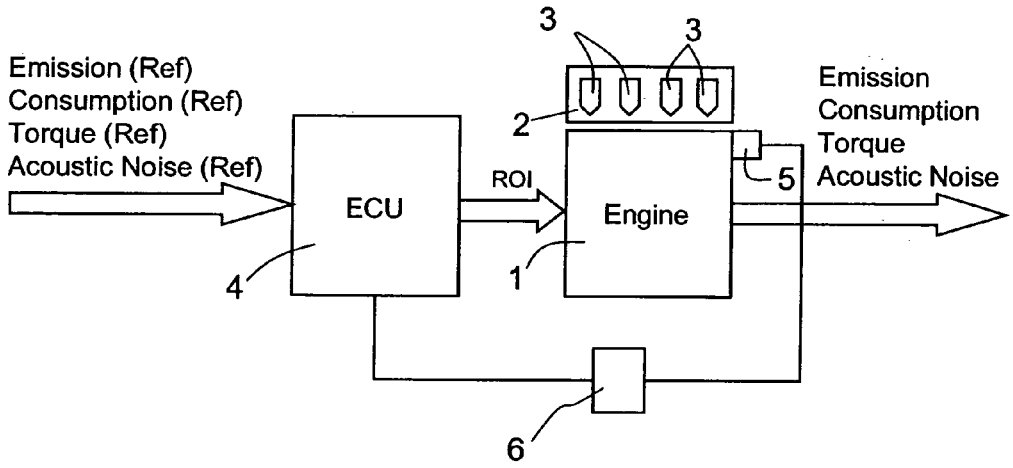
Fig. 1 (Prior Art)
FIG. 1 shows a schematic block diagram of a closed-loop control device used in a laboratory on experimental car prototypes.
Figure 2:
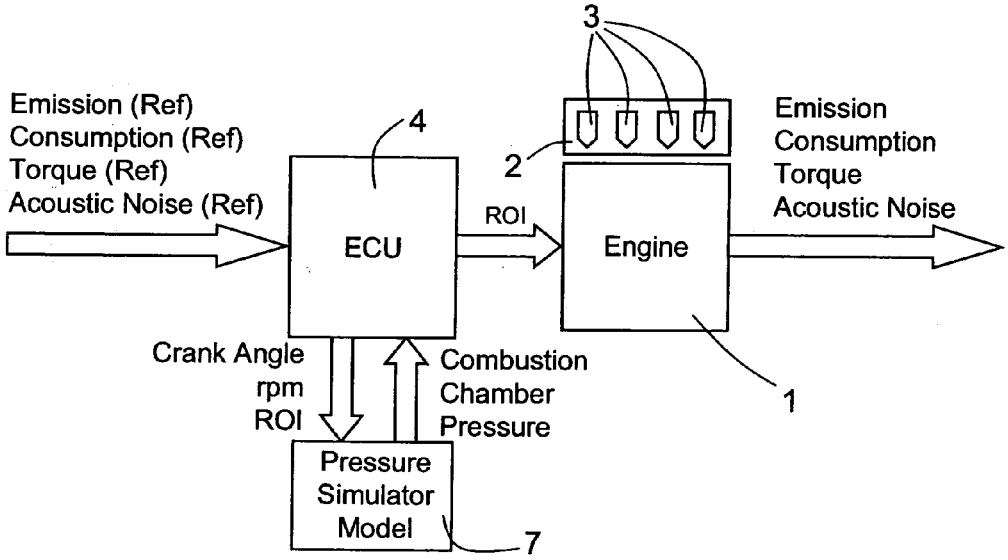
FIG. 2 shows a schematic block diagram of a control device for cars intended for the market using a determining device according to the invention.

FIG. 2 shows a schematic block diagram of a control system using a virtual sensor according to the present invention. As can be seen, the instantaneous fuel flow rate ROI to be injected in the engine 1 is adjusted by the electronic control unit 4, which operates on the basis of reference values of engine quantities to be optimized such as consumption, exhaust emission levels, engine torque, acoustic noise, all of which can be indirectly obtained from the pressure in the combustion chamber. The pressure in the combustion chamber is estimated in real time by means of a virtual pressure sensor 7 according to the invention, and the pressure signal generated thereby is supplied to the electronic control unit 4, which processes it in order to assess by how much the actual values of the quantities to be optimized differ from the reference values. This information is then used by the electronic control unit 4 to choose the most suitable injection law to be implemented in the next engine cycle to optimize the above-mentioned engine quantities.

The virtual sensor 7 can be made as a distinct electronic device, independent from and connected to the electronic control unit 4, as shown in FIG. 2, thus substituting a real instrument for detecting pressure in the combustion chamber, or its functions may be incorporated in the electronic control unit 4.

The virtual sensor 7 is nothing else than a device implementing a mathematical model through which it is possible to simulate what happens in the combustion chamber and to derive therefrom, instant by instant, the instantaneous pressure value in the combustion chamber (Pressure Simulator Model).

The mathematical model on which the virtual sensor is based implements the first thermodynamic principle equation, applied to the cylinder-piston system:

$$\frac{dQ_b}{d\theta} = \frac{dE}{d\theta} + \frac{dL}{d\theta} + \frac{dQ_r}{d\theta}$$

where:

L represents the work performed by the system

E represents the internal energy of the system $Q_b$ represents the heat produced by combustion $Q_r$ represents the heat lost by the system and θ represents the angular position of the engine crankshaft, hereinafter referred to for brevity's sake as the crank angle.

The above equation expresses in mathematical terms the physical principle according to which at the general crank angle θ, the flow of heat released by the combustion reactions ($dQ_b/d\theta$) balances the variation of the internal energy ($dE/d\theta$) of the system, the mechanical power exchanged with the external environment ($dL/d\theta$) through the piston and the flow of heat lost by transmission through the walls of the cylinder-piston system both by convection and by irradiation ($dQ_r/d\theta$).

As regards the individual quantities that appear in the previous equation, the heat ($Q_b$) developed by the combustion of the air-fuel mixture can for example be modeled by means of a double Wiebe function (for a detailed discussion of this model, see for example *Motori a combustione interna*, G. Ferrari, Edizioni II Capitello, Turin, Chapter 11); the heat exchanged ($Q_r$) with the outside environment can, for example, be modeled using the heat transmission model proposed by Woschni (for a detailed discussion of this model, see also *Motori a combustione interna*, G. Ferrari, Edizioni II Capitello, Turin, Chapter 14); the internal energy (E) can, for example, be calculated considering the fluid as a perfect gas at a certain temperature; and lastly the work (L) exchanged with the outside environment can, for example, be calculated considering the cylinder-piston system as a variable geometry system according to the crank gear law.

Making each of the terms of the previous equation explicit as a function of the pressure variation $dP/d\theta$ which takes place inside the cylinder, four distinct contributions to the overall pressure variation can be identified:

$$\frac{dP(rpm,\theta)}{d\theta} = \frac{dP(\theta)_{MOTORED}}{d\theta} + \frac{dP(\theta)_{BURNING}}{d\theta} + \frac{dP(\theta)_{LOSS}}{d\theta} + \frac{dP(rpm,\theta)_{\mathrm{VALVE_LIFT}}}{d\theta}$$

where:

$dP(\theta)_{MOTORED}/d\theta$ represents the contribution due to the compression and subsequent expansion of the working fluid inside the cylinder by the piston, which takes place according to the known crank gear law, following with good approximation a polytropic thermodynamic transformation. Having fixed the engine geometry (stroke, bore, compression ratio) and the polytropic exponent, it depends solely on the crank angle θ;

$dP(\theta)_{BURNING}/d\theta$ represents the contribution due to the chemical reaction of combustion of the air-fuel mixture. Using a combustion heat release model, such as the double Wiebe model, this term depends only on the crank angle θ, as well as on certain parameters which have been chosen in an optimum manner as described below;

$dP(\theta)_{LOSS}/d\theta$ represents the contribution due to the heat losses by conduction and irradiation through the walls of the cylinder and the surface of the piston. Having chosen a heat transmission model, such as the Woschni model, this term depends only on the crank angle θ, as well as on certain parameters which have been chosen in an optimum manner as described below; and $dP_{VALVE_LIFT}/d\theta$ represents the contribution due to the delay in closing and opening the suction and discharge valves which do not take place instantaneously in the passage from the phases of suction/compression and expansion/discharge (remember on this point that the model developed simulates only the behavior of pressure with "closed valves", that is during the engine phases of compression and expansion). This term depends both on the crank angle θ and on the angular velocity of the engine shaft (rpm), hereinafter referred to for brevity's sake as the engine speed.

In particular, the dependence of the individual quantities that appear in the first thermodynamic principle equation on the pressure in the combustion chamber is not described here in detail since it is widely known in the literature. In fact, the dependence of the developed heat ($Q_b$) on pressure can be derived directly from the above-mentioned double Wiebe function, the dependence of the exchanged heat ($Q_r$) on pressure can also be derived directly from the Woschni model, the dependence of the internal energy (E) on pressure derives from the physical law according to which energy depends on temperature through the mass and the specific heat at constant volume and temperature depends on pressure according to the perfect gas law, and lastly the dependence of work (L) on pressure derives from the physical law according to which the work is equal to the product of pressure multiplied by volume.

Moreover, it is considered useful to point out the fact that the previous equation does not contain any multiplying or adding constants, since it has the sole purpose of indicating to the reader which are the contributions that together determine the pressure variation in the combustion chamber and not that of defining a mathematically strict relationship between the pressure in the combustion chamber and the various physical quantities.

Estimating the computational weights of the four terms that appear in the previous equation, the term $dP_{VALVE_LIFT}/d\theta$ may be laborious to process, making it impossible to perform a run-time model simulation.

It is therefore possible to eliminate that term and to account for it by means of a simplified equivalent model, in particular by suitably modifying the other terms that contribute to the overall pressure variation. In fact, the effect of the lifting of the valve causes a variation of the exponent n of the polytropic transformation with which the behavior of a thermal engine and of the geometric compression ratio (which does not appear explicitly but is contained in the calculation of the total volume V) is described. So, in the simplified equivalent model a variability with θ of these two quantities (n, V) may be added, and in particular, since the eliminated term depends strongly on the angular velocity, their dependence on the angular velocity of the engine may also be advantageously taken into account according to a look-up table obtained experimentally.

Finally the simplified equivalent model may be described by means of the following equation:

$$\frac{dP(rpm,\theta)}{d\theta} = \frac{dP(rpm,\theta)_{MOTORED}}{d\theta} + \frac{dP(rpm,\theta)_{BURNING}}{d\theta} + \frac{dP(rpm,\theta)_{LOSS}}{d\theta}$$

in which:

$$\frac{dP(rpm,\theta)_{MOTORED}}{d\theta} = -\frac{n(rpm,\theta)}{V(\theta)} \cdot P \cdot \frac{dV}{d\theta}$$

$$\frac{dP(rpm,\theta)_{BURNING}}{d\theta} = \frac{n(rpm,\theta)-1}{V(\theta)} \cdot m_c \cdot H \cdot \frac{dx_b}{d\theta}$$

$$\frac{dP(rpm,\theta)_{LOSS}}{d\theta} = -\frac{n(rpm,\theta)-1}{V(\theta)} \cdot \frac{S}{\varpi} \cdot h_i \cdot (T_g - T_i)$$

and where:

$dP(rpm,\theta)_{MOTORED}/d\theta$ represents the contribution to pressure variation due to the geometric variation of the cylinder-piston system as the crank angle θ varies;

$dP(rpm,\theta)_{BURNING}/d\theta$ represents the contribution to pressure variation due to combustion; and $dP(rpm,\theta)_{LOSS}/d\theta$ represents the contribution to pressure variation due to heat losses through the radiating walls of the cylinder and of the piston, having indicated with:

rpm the angular velocity of the engine shaft [revs/minute]

θ the angular position of the engine shaft or crank angle

H the lower heating power of the fuel $x_b$ the mass fraction of the burnt fuel n the exponent of the polytropic transformation $m_c$ the quantity (expressed in mass) of fuel injected per engine cycle S the working surface of heat exchange between the fluid inside the combustion chamber (air-fuel mixture) and the walls of the piston and of the cylinder (function of the crank angle θ)

$\varpi$ the angular velocity of the engine shaft [radians/second]

$h_i$ the instantaneous coefficient of global transmission between the fluid present in the combustion chamber and the radiating surface $T_g$ the temperature of the fluid inside the combustion chamber $T_i$ the temperature of the inside walls of the cylinder V the instantaneous volume occupied by the fluid The above-mentioned experimental look-up table with which it is possible to express the dependence of n and V on the engine speed can be obtained as follows.

First of all the behavior of the engine in "motored" operation is analyzed, that is in the absence of combustion. In particular, the pressure value in the laboratory is measured, and, since the mathematical relation (a polytropic thermodynamic transformation) which links pressure, volume and the exponent of the polytropic transformation n is known and since the volume that can be calculated from the engine geometry and from the crank gear law is known, it is possible obtain the latter with the varying of the crank angle (θ) and of the angular velocity (rpm) of the engine shaft.

The estimate of the real compressions ratio is obtained similarly: knowing the maximum pressure, which can be measured experimentally, and the mathematical relation which links it to the real compression ratio by means of the value of n and the pressure at the start of intake, which is with fair approximation the same as atmospheric pressure, it is possible to obtain the value of the real compression ratio, the only unknown in the mathematical relation.

Figure 3:
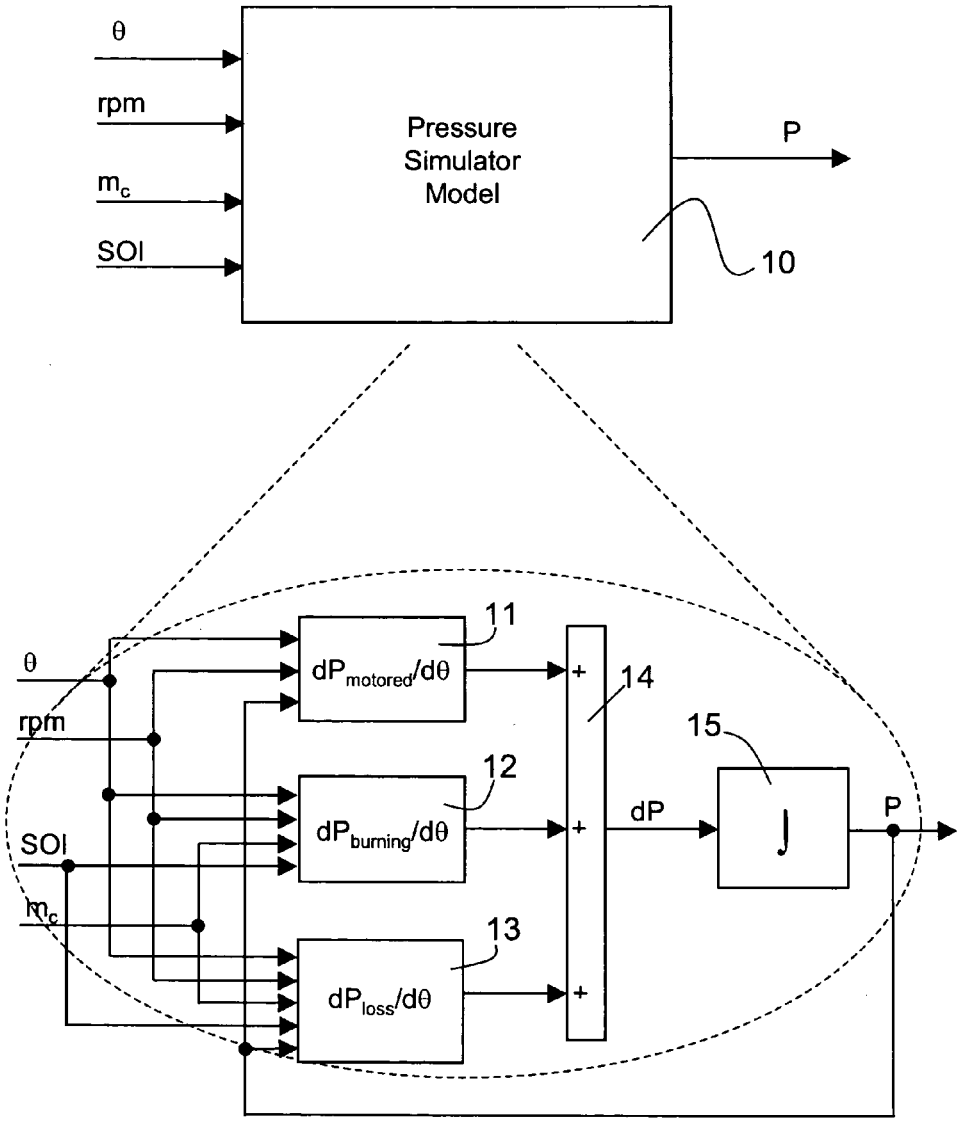
FIG. 3 shows a functional block diagram of a device for determining the instantaneous pressure value in the combustion chamber of an internal combustion engine according to the present invention.

In the light of the above, the virtual sensor according to the present invention can be functionally schematized by means of the block diagram shown in FIG. 3, that is by means of a calculation block 10 receiving the crank angle θ, the engine speed rpm, and the injection law ROI, which in turn is defined by the quantity of fuel $m_c$ (expressed in mass) injected into the engine at every engine cycle and by the instant of start of injection SOI (expressed in crank angle), and supplying the instantaneous value of the pressure P in the combustion chamber of the engine.

In particular, the block 10 is made up of:

a first calculation block 11 receiving the crank angle θ, the engine speed rpm, and the previous instantaneous value of the pressure P, calculated and supplied by the block 10, and supplying the value of the contribution $dP(rpm,\theta)_{MOTORED}/$ $d\theta$ to the pressure variation due to the compression and subsequent expansion of the fuel inside the cylinder by the piston;

a second calculation block 12 receiving the crank angle $\theta$, the engine speed rpm, the quantity of fuel $m_c$ injected into the engine in the current engine cycle and the instant of start of injection SOI, and supplying the value of the contribution $dP(rpm, \theta)_{BURNING}/d\theta$ to the pressure variation due to the chemical reaction of combustion of the air-fuel mixture;

a third calculation block 13 receiving the crank angle $\theta$, the engine speed rpm, the quantity of fuel $m_c$ injected into the engine in the current engine cycle, the instant of start of injection SOI and the previous instantaneous value of the pressure P calculated and supplied by block 10, and supplying the value of the contribution $dP(rpm, \theta)_{LOSS}/d\theta$ to the pressure variation due to the heat losses by conduction and irradiation through the walls of the cylinder and the surface of the piston;

an adder block 14 receiving the three contributions $dP(rpm, \theta)_{MOTORED}/d\theta$, $dP(rpm, \theta)_{BURNING}/d\theta$ and $dP(rpm, \theta)_{LOSS}/d\theta$ supplied by the three calculation blocks 11, 12 and 13, and supplying the pressure variation $dP(rpm, \theta)/d\theta$ as the sum of the above-mentioned three contributions; and an integration block 15 receiving the pressure variation $dP(rpm, \theta)/d\theta$ supplied by the adder block 14 and supplying the instantaneous pressure value P in the combustion chamber of the engine, value which, as stated above, is supplied to the calculation blocks 11 and 13 for the calculation of the subsequent instantaneous pressure value P.

Figure 4:
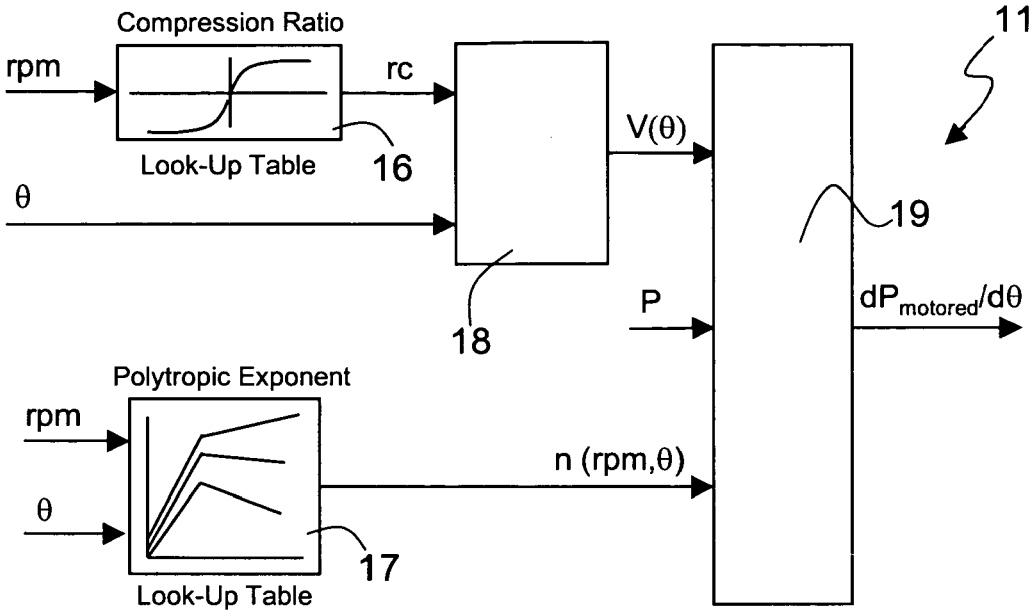
FIGS. 4, 5 and 6 show more in detail functional block diagrams of parts of the determining device in FIG. 3.
Figure 5:
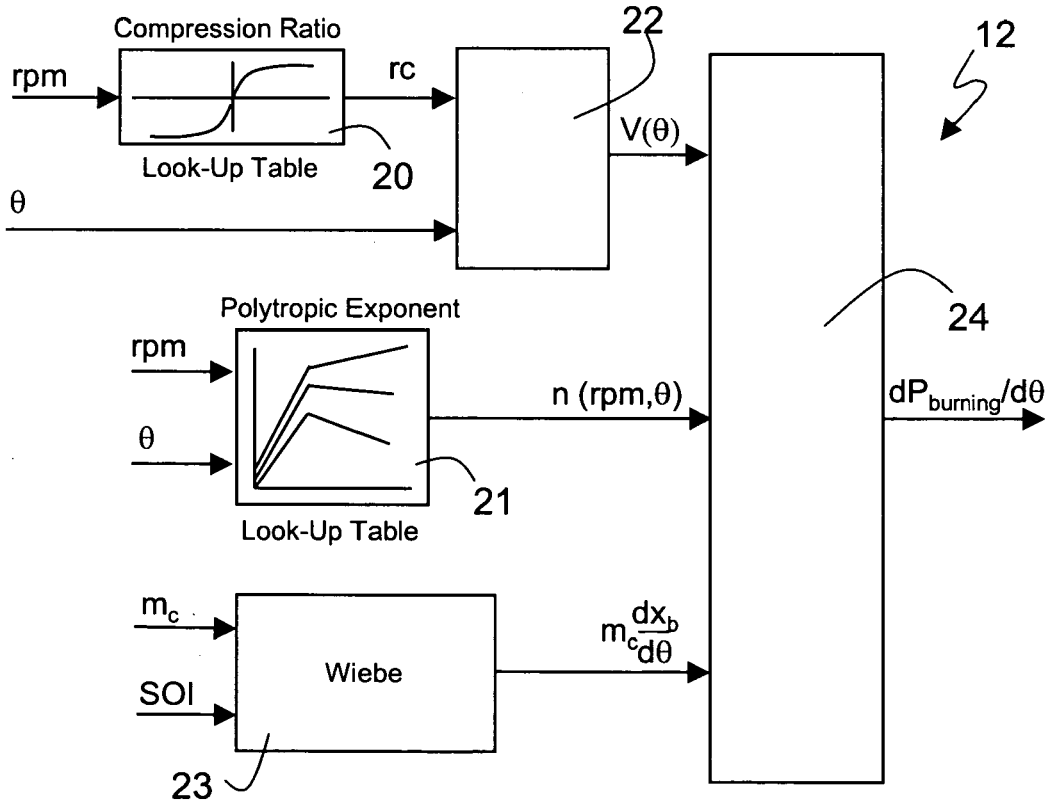
Figure 6:
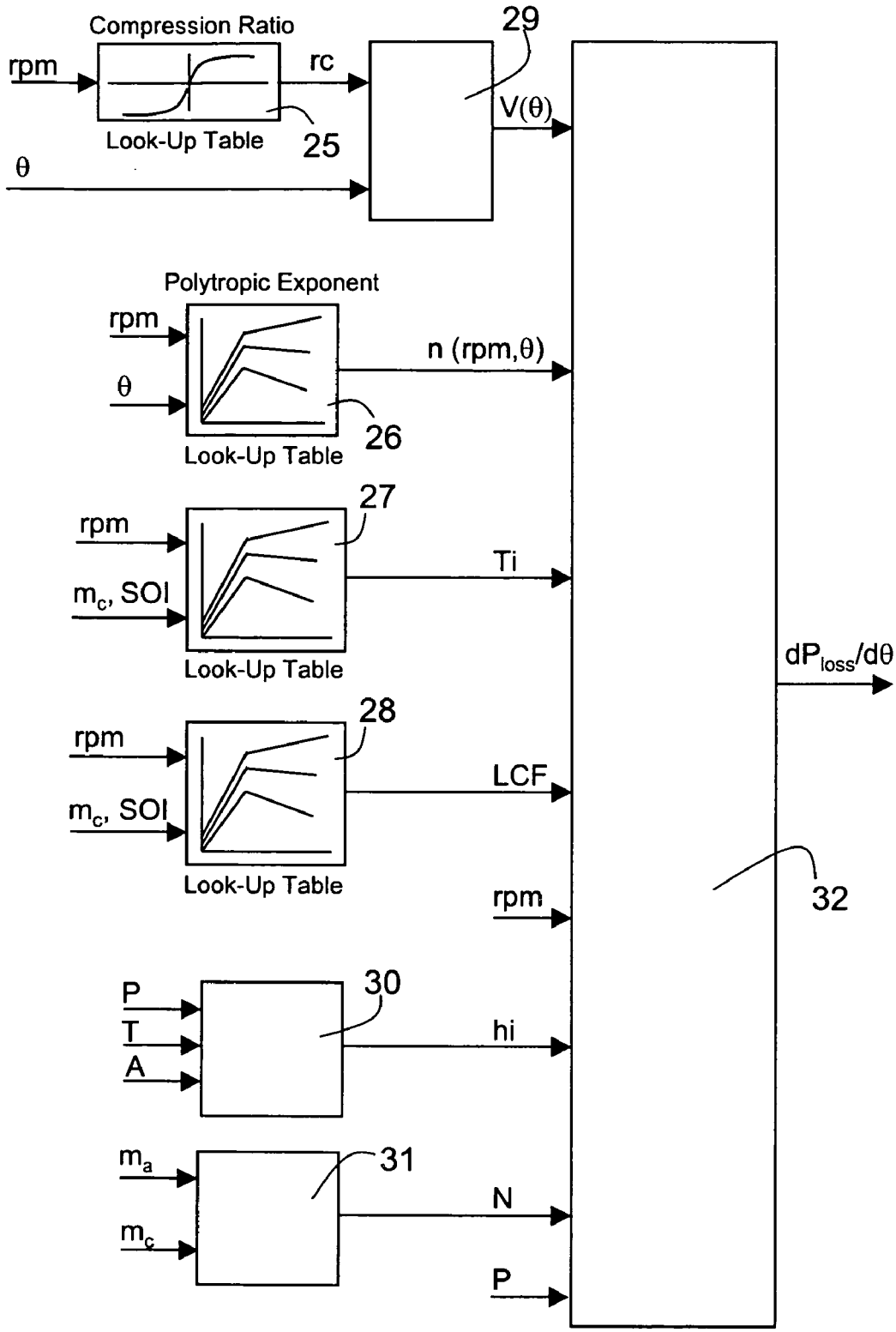

FIGS. 4, 5 and 6 show the functional block diagrams of the calculation blocks 11, 12 and 13.

In particular, as shown in FIG. 4, the first calculation block 11 comprises:

a first calculation block 16 memorizing a first look-up table which defines a mathematical relation between the (real) compression ratio rc and the engine speed rpm, in particular containing, for each value of the engine speed rpm, a respective value of the compression ratio rc, the first calculation block 16 receiving the value of the engine speed rpm and supplying a respective value of the compression ratio rc;

a second calculation block 17 memorizing a second look-up table which defines a mathematical relation between the engine speed rpm, the rank angle $\theta$ and the exponent n of the polytropic transformation, in particular containing, for each combination of values of the engine speed rpm and of the crank angle $\theta$, a respective value of the exponent n of the polytropic transformation, the second calculation block 17 receiving the values of the engine speed rpm and of the crank angle $\theta$ and supplying a respective value of the exponent n of the polytropic transformation;

a third calculation block 18 receiving the values of the compression ratio rc supplied by the calculation block 16 and of the crank angle $\theta$ and supplying the value of the instantaneous volume $V(\theta)$ occupied by the air-fuel mixture; and a fourth calculation block 19 receiving the previous instantaneous value of the pressure P supplied by the block 10 and the values of the instantaneous volume $V(\theta)$ occupied by the air-fuel mixture supplied by the third calculation block 18 and of the exponent n of the polytropic transformation supplied by the second calculation block 17 and supplying the value of the contribution $dP(rpm, \theta)_{MOTORED}/d\theta$ to the pressure variation in the combustion chamber due to the compression and subsequent expansion of the fuel inside the cylinder by the piston, contribution which is calculated according to the equation indicated previously.

Instead, as shown in FIG. 5, the second calculation block 12 comprises:

a first calculation block 20 identical to the first calculation block 16 in FIG. 4, receiving the value of the engine speed rpm and supplying a respective value of the compression ratio rc;

a second calculation block 21 identical to the second calculation block 17 in FIG. 4, receiving the values of the engine speed rpm and of the crank angle $\theta$ and supplying a respective value of the exponent n of the polytropic transformation;

a third calculation block 22 receiving the values of the compression ratio rc supplied by the calculation block 20 and of the crank angle $\theta$ and supplying the value of the instantaneous volume $V(\theta)$ occupied by the fuel;

a fourth calculation block 23 implementing the above-mentioned optimized double Wiebe function, receiving the quantity of fuel $m_c$ injected into the engine and the instant of the start of injection SOI and supplying the value of the term $m_c \cdot (dx_b/d\theta)$ which appears in the equation of the contribution $dP(rpm, \theta)_{BURNING}/d\theta$ to the pressure variation in the combustion chamber due to the chemical reaction of combustion of the air-fuel mixture; and a fifth calculation block 24 receiving the values of the instantaneous volume $V(\theta)$ occupied by the air-fuel mixture supplied by the calculation block 22, of the exponent n of the polytropic transformation supplied by the calculation block 21, and of the term $m_c \cdot (dx_b/d\theta)$ supplied by the calculation block 23 and supplying the value of the contribution $dP(rpm, \theta)_{BURNING}/d\theta$, which is calculated according to the equation indicated previously.

Lastly, as shown in FIG. 6, the third calculation block 13 comprises:

a first calculation block 25 identical to the first calculation block 16 in FIG. 4, receiving the value of the engine speed rpm and supplying a respective value of the compression ratio rc;

a second calculation block 26 identical to the second calculation block 17 in FIG. 4, receiving the values of the engine speed rpm and of the crank angle $\theta$ and supplying a respective value of the exponent n of the polytropic transformation;

a third calculation block 27 memorizing a third look-up table which defines a mathematical relation between the engine speed rpm, the quantity of fuel $m_c$ injected into the engine, the instant of the start of injection SOI and the temperature $T_i$ of the inside walls of the cylinder, in particular containing, for each combination of values of the engine speed rpm, of the quantity of fuel $m_c$ injected into the motor and of the instant of the start of injection SOI, a respective value of the temperature $T_i$ of the inside walls of the cylinder, the third calculation block 27 receiving the values of the engine speed rpm, of the quantity of fuel $m_c$ injected into the engine and of the instant of the start of injection SOI and supplying a respective value of the temperature $T_i$ of the inside walls of the cylinder;

a fourth calculation block 28 memorizing a fourth look-up table which defines a mathematical relation between the engine speed rpm, the quantity of fuel $m_c$ injected into the engine, the instant of the start of injection SOI and a loss calibration factor LCF ( ), in particular containing, for each combination of values of the engine speed rpm, of the quantity of fuel $m_c$ injected into the engine and of the instant of the start of injection SOI, a respective value of the loss calibration factor LCF, the fourth calculation block 28 receiving the values of the engine speed rpm, of the quantity of fuel $m_c$ injected into the engine and of the instant of the start of injection SOI and supplying the value of the loss calibration factor LCF;

a fifth calculation block 29 receiving the values of the compression ratio rc supplied by the calculation block 25 and of the crank angle θ and supplying the value of the instantaneous volume V(θ) occupied by the fuel;

a sixth calculation block 30 implementing the above-mentioned Woschni model, receiving the previous instantaneous pressure value P supplied by the block 10 and the values of the temperature $T_g$ of the fluid inside the combustion chamber and of the bore A of the engine cylinders (engine parameter memorized in the electronic control unit) and supplying the value of the instantaneous coefficient $h_i$ of global transmission between fluid and radiating surface (for the equation with which to calculate the instantaneous coefficient $h_i$ see the above-mentioned *Motori a combustione interna*);

a seventh calculation block 31 receiving the quantity of fuel $m_c$ injected into the engine and the quantity of air ma sent into the cylinder and supplying the number N of moles of the fluid inside the combustion chamber, as described below; and an eighth calculation block 32 receiving the values of the instantaneous volume V(θ) occupied by the fuel supplied by the calculation block 29, of the exponent n of the polytropic transformation supplied by the calculation block 26, of the loss calibration factor LCF supplied by the calculation block 28, of the engine speed rpm, and of the instantaneous coefficient $h_i$ of global transmission between fluid and radiating surface, as well as the number N of moles of the working fluid supplied by the calculation block 31, and the previous instantaneous pressure value P supplied by the block 10, and supplying the value of the contribution $dP(rpm, \theta)_{LOSS}/d\theta$ to the pressure variation in the combustion chamber due to the heat losses through the radiating walls of the piston and of the cylinder, which is calculated according to the equation indicated previously.

In particular, in calculation block 31 the number N of moles of the fluid inside the combustion chamber is calculated according to the equation:

$$N = \frac{m_a}{M_a} + \frac{m_c}{M_c}$$

in which:

$$m_a = \rho_a \cdot V_T = \rho_a \cdot (V_{cy} + V_{cc})$$

having indicated with:

$\rho_a$ the density of the air at environment temperature $V_{cy}$ the volume of the cylinder $V_{cc}$ the volume of the combustion chamber $V_T$ the total volume (cylinder+combustion chamber)

$M_a$ the molecular mass of the air (with fair approximation equal to 29)

$M_c$ the molecular mass of the fuel (with fair approximation equal to 200)

Moreover, in the calculation block 32 the value of the temperature $T_g$ of the fluid inside the combustion chamber which appears in the equation of the contribution $dP(rpm, \theta)_{LOSS}/d\theta$ can be obtained with fair approximation from the perfect gas state law, therefore as a function of the values of the pressure P and of the volume V, knowing the number of moles N of the working fluid. In fact, the value of the volume can be obtained from the mass of fuel $m_c$ injected and from the mass of air $m_a$ sent into the cylinder, knowing the molecular masses of the two elements. Instead, the value of the coefficient $h_i$, using the Woschni model to model losses, is a function of the values of pressure, temperature and bore, the last being a geometric parametric characteristic of the specific engine being examined and memorized in the electronic control unit.

Moreover, the mathematical model on which the virtual sensor according to the invention is based, model which, as stated above, implements the equation of the first thermodynamic principle applied to the cylinder-piston system, needs, like all mathematical models, an initial optimization or calibration so that the estimated pressure approximates as accurately as possible the pressure that can be measured experimentally. This optimization can be conveniently accomplished by parameterizing, using soft-computing techniques, numerous thermodynamic variables, such as the engine speed, the mass of injected fuel and the instant of start of injection, and other operative parameters listed below, and by calculating, for each possible combination of inputs, for example by means of a genetic algorithm, the combination of the values of the above-mentioned thermodynamic variables and of the above-mentioned operative parameters which leads to the best approximation of the estimated pressure. These combinations of values are then inserted in a look-up table which the model uses in the calculation of the theoretical cycle.

In particular, the applicant has experimentally checked that the operative parameters that should be considered in optimization are:

fraction of fuel burn in the premixed phase (β);

angular delay of the start of combustion (d) with respect to the angle of injection;

temperature of the walls of the cylinder ($T_i$);

loss calibration factor (LCF);

duration of the premixed phase ($t_p$);

duration of the diffusive phase ($t_d$);

form factor of the premixed phase (first vibe) ($m_p$); e form factor of the diffusive phase (second vibe) ($m_d$), said form factors appearing in the double Wiebe model mentioned above.

In particular, the applicant has checked that the ranges of parameters that can be used in optimization are:

| | | | | |
|---|---|---|---|---|
| β[−] | : | 0 | - | 1 |
| d[deg] | : | 0 | - | 15 |
| $T_i$[K] | : | 300 | - | 1000 |
| LCF[−] | : | 0 | - | 1 |
| $t_p$[deg] | : | 0 | - | 10 |
| $t_d$[deg] | : | 0 | - | 80 |
| $m_p$[−] | : | 0 | - | 4 |
| $m_d$[−] | : | 0 | - | 2 |

Figure 7:
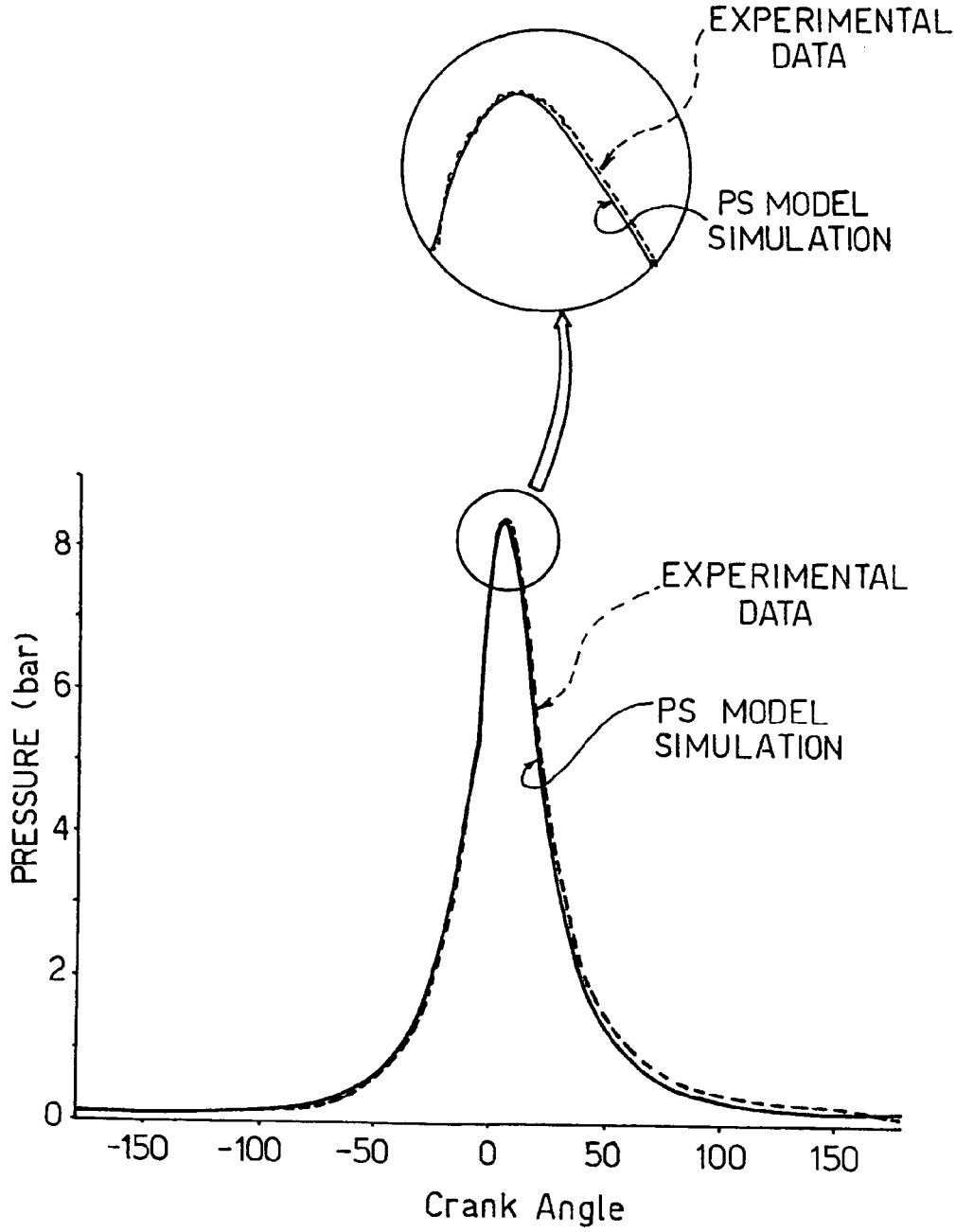
FIG. 7 shows comparatively a pressure cycle measured in laboratory by means of a sensor arranged in a combustion chamber and a pressure cycle determined by means of the present invention.

FIG. 7 shows a pressure cycle acquired in laboratory by means of a kistler dynamic pressure sensor arranged in the combustion chamber (dotted line) and a pressure cycle determined according to the present invention (continuous line) of a spontaneous ignition engine with small displacement (225 cc on the bench) and compression ratio of 21.1, at 60% with respect to the maximum load and at 2200 rpm.

As may be seen, the pressure curve estimated using the present invention gives an almost optimum approximation of the pressure curve measured by means of a dynamic pressure sensor arranged in the combustion chamber and the only errors that can be seen are made corresponding to the pressure peak and in the expansion phase, but these are less than three bar, that is less than 5%, and this precision is sufficient for a good engine control.

The advantages of the present invention are clear from the above description.

In particular, the present invention allows a reliable determination of the pressure value in the combustion chamber during operation of the engine without requiring the installation inside the combustion chamber of an expensive pressure sensor that would be complicated to install and maintain. The estimated pressure can therefore be exploited to realize the same feedback which is realized by means of a real sensor. In this way it is possible to plan a closed-loop control system based on the virtually sensor according to the invention, with all the economic and practical advantages that it offers (no installation, maintenance or additional hardware), and without having to physically realize the feedback channel.

In this way, the present invention allows the combination of the benefits in terms of costs typical of open-loop control systems with the benefits in terms of performance typical of closed-loop control systems.

Lastly it is clear that modifications and variations may be made to all that is described and illustrated here without departing from the scope of protection of the present invention, as defined in the appended claims.

The invention claimed is:

1. A method for determining a pressure in a combustion chamber of an engine, equipped with an electronically controlled fuel injection system, said method comprising:

generating a physical-mathematical model; and based on the physical-mathematical model, determining the pressure in the combustion chamber of the engine as a function of engine kinematic quantities and of a fuel injection law, said physical-mathematical model using a contribution to the pressure due to heat release during combustion as part of said determining the pressure.

2. A method according to claim 1 wherein said engine kinematic quantities comprise an engine speed and a crank angle.

3. The method according to claim 1 wherein the fuel injection law is defined by a quantity of fuel injected and by a start of injection of said fuel.

4. The method according to claim 3 wherein said start of injection is defined by a crank angle at the start of injection.

5. The method according to claim 1 wherein the engine is a spontaneous combustion engine.

6. The method according to claim 1 wherein the engine is an internal combustion engine with fuel injection.

7. The method according to claim 1 wherein the engine is an induced combustion engine.

8. The method according to claim 1 wherein determining the pressure in the combustion chamber comprises:

determining a first contribution to a pressure variation in the combustion chamber due to a variation of a volume occupied by a fluid present in a cylinder resulting from movement of a piston;

determining a second contribution to the pressure variation in the combustion chamber due to combustion of the fluid present in the cylinder;

determining a third contribution to the pressure variation in the combustion chamber due to heat losses through walls of the piston and of the cylinder, said heat losses including heat loss by transmission both by convection and by irradiation as modeled by said physical-mathematical model; and determining the pressure in the combustion chamber as a function of said first, second and third contributions.

9. The method according to claim 8 wherein determining a first contribution to the pressure variation in the combustion chamber comprises:

determining an engine compression ratio as a function of engine speed;

determining the volume occupied by the fluid present in the cylinder as a function of the compression ratio and of a crank angle;

determining an exponent of a polytropic thermodynamic transformation undergone by the fluid present in the cylinder during its compression and subsequent expansion as a function of the engine speed and of the crank angle; and determining said first contribution to the pressure variation in the combustion chamber as a function of the volume occupied by the fluid present in the cylinder, of the exponent of the polytropic thermodynamic transformation, and of the pressure in the combustion chamber.

10. The method according to claim 8 wherein determining a second contribution to the pressure variation in the combustion chamber comprises:

determining an engine compression ratio as a function of engine speed;

determining the volume occupied by the fluid present in the cylinder as a functions of the compression ratio and of a crank angle;

determining an exponent of a polytropic thermodynamic transformation undergone by the fluid present in the cylinder during its compression and subsequent expansion as a function of the engine speed and of the crank angle;

determining a variation of a fraction of fluid burnt with a varying of the crank angle; and determining said second contribution to the pressure variation in the combustion chamber as a function of the volume occupied by the fluid present in the cylinder, of the exponent of the polytropic thermodynamic transformation, of a mass of fuel injection, and of the variation of the fraction of fluid burnt.

11. The method according to claim 8 wherein determining a third contribution to the pressure variation in the combustion chamber comprises the steps of:

determining an engine compression ratio as a function of engine speed;

determining the volume occupied by the fluid present in the cylinder as a function of the compression ratio and of a crank angle;

determining an exponent of a polytropic thermodynamic transformation undergone by the fluid present in the cylinder during its compression and subsequent expansion as a function of the engine speed and of the crank angle;

determining a temperature of internal walls of the cylinder as a function of the engine speed, of injected fuel quantity, and of a start of injection;

determining a loss calibration factor as a function of the engine speed, of the injected fuel quantity, and of the start of injection;

determining a transmission coefficient between the fluid present in the combustion chamber and a radiating surface of the piston and of the cylinder as a function of the pressure in the combustion chamber, of a temperature of the fluid present in the combustion chamber, and of an engine bore;

determining a number of moles of the fluid present in the combustion chamber as a function of the injected fuel quantity and of a quantity of air intake; and determining said third contribution to the pressure variation in the combustion chamber as a function of the volume occupied by the fluid present in the cylinder, of the exponent of the polytropic thermodynamic transformation, of the temperature of the inside walls of the cylinder, of the loss calibration factor, of the engine speed, of the transmission coefficient, of the number of moles, and of the pressure in the combustion chamber.

12. The method according to claim 8 wherein determining said pressure as a function of said contributions comprises:

adding said first, second and third contribution; and integrating said first, second and third contribution.

13. The method of claim 1 wherein a difference between said pressure determined based on said mathematical-physical model and an actual pressure is less than 5%.

14. A method for controlling fuel injection in an internal combustion engine, the method comprising:

determining a pressure in a combustion chamber of the engine as a function of engine kinematic quantities and of a fuel injection law, including determining and using a contribution to pressure variation due to heat loss; and controlling said fuel injection on a basis of said pressure in the combustion chamber.

15. A device for controlling fuel injection in an internal combustion engine, equipped with an electronically controlled fuel injection system and with electronic control means for receiving engine quantities including a pressure in a combustion chamber and for closed-loop controlling said fuel injection system based on said pressure in the combustion chamber, said device for controlling comprising a device for determining the pressure in the combustion chamber of the engine according to claim 14.

16. The method of claim 14 wherein a difference between said determined pressure and an actual pressure is less than 5%.

17. The method of claim 14 wherein determining the pressure as the function of the fuel injection law includes using a quantity of fuel injected and a start of injection of said fuel to determine a contribution to pressure variation, and wherein determining the pressure as the function of the engine kinematic quantities includes using an engine speed to determine a contribution to pressure variation.

18. The method of claim 14 wherein determining the pressure includes determining the pressure in a spontaneous combustion engine.

19. A device for determining a pressure in a combustion chamber of an internal combustion engine, equipped with an electronically controlled fuel injection system, said determining device comprising:

first calculation means for determining the pressure in the combustion chamber, using a physical-mathematical model, as a function of engine kinematic quantities and of a fuel injection law, said physical-mathematical model using a contribution to the pressure due to heat release during combustion as part of said determining the pressure; and means for providing the determined pressure to an engine control unit to allow the engine control unit to control the fuel injection system.

20. The device according to claim 19 wherein said engine kinematic quantities comprise an engine speed and a crank angle.

21. The device according to claim 19 wherein said injection law is defined by a quantity of fuel injected and by a start of injection of said fuel.

22. The device according to claim 21 wherein said start of injection is defined by a crank angle at the start of injection.

23. The device according to claim 19 wherein said first calculation means comprise:

second means for determining a first contribution to a pressure variation in the combustion chamber due to a variation of a volume occupied by a fluid present in a cylinder resulting from movement of a piston;

third means for determining a second contribution to the pressure variation in the combustion chamber due to a combustion of the fluid present in the cylinder;

fourth means for determining a third contribution to the pressure variation in the combustion chamber due to heat losses through walls of the piston and of the cylinder, said heat losses including heat loss by transmission both by convection and by irradiation as modeled by said physical-mathematical model; and fifth means for determining the pressure in the combustion chamber as a function of said first, second and third contributions.

24. The device according to claim 23 wherein said second means comprise:

a first calculation block for determining an engine compression ratio as a function of engine speed;

a second calculation block for determining the volume occupied by the fluid present in the cylinder as a function of the compression ratio and of a crank angle;

a third calculation block for determining an exponent of a polytropic thermodynamic transformation undergone by the fluid present in the cylinder during its compression and subsequent expansion as a function of the engine speed and of the crank angle; and a fourth calculation block for determining said first contribution to the pressure variation in the combustion chamber as a function of the volume occupied by the fluid present in the cylinder, of the exponent of the polytropic thermodynamic transformation, and of the pressure in the combustion chamber.

25. The device according to claim 23 wherein said third means comprise:

a first calculation block for determining an engine compression ratio as a function of engine speed;

a second calculation block for determining the volume occupied by the fluid present in the cylinder as a function of the compression ratio and of a crank angle;

a third calculation block for determining an exponent of the polytropic thermodynamic transformation undergone by the fluid present in the cylinder during its compression and subsequent expansion as a function of the engine speed and of the crank angle;

a fourth calculation block for determining a variation of a fraction of fluid burnt with a varying of the crank angle; and a fifth calculation block for determining said second contribution to the pressure variation in the combustion chamber as a function of the volume occupied by the fluid present in the cylinder, of the exponent of the polytropic thermodynamic transformation, of a mass of injected fuel, and of the variation of the fraction of burnt fluid.

26. The device according to claim 23 wherein said fourth means comprise:

a first calculation block for determining an engine compression ratio as a function of engine speed;

a second calculation block for determining the volume occupied by the fluid present in the cylinder as a function of the compression ratio and of a crank angle;

a third calculation block for determining an exponent of a polytropic thermodynamic transformation undergone by the fluid present in the cylinder during its compression and subsequent expansion as a function of the engine speed and of the crank angle;

a fourth calculation block for determining a temperature of the inside walls of the cylinder as a function of the engine speed, of an injected fuel quantity, and of a start of injection;

a fifth calculation block for determining a loss calibration factor as a function of the engine speed, of the injected fuel quantity, and of the start of injection;

a sixth calculation block for determining a transmission coefficient between the fluid present in the combustion chamber and a radiating surface of the piston and of the cylinder as a function of the pressure in the combustion chamber, of the temperature of the fluid present in the combustion chamber, and of an engine bore;

a seventh calculation block for determining a number of moles of the fluid present in the combustion chamber as a function of the injected fuel quantity and of an air intake; and an eighth calculation block for determining said third contribution to the pressure variation in the combustion chamber as a function of the volume occupied by the fluid present in the cylinder, of the exponent of the polytropic thermodynamic transformation, of the temperature of the inside walls of the cylinder, of the loss calibration factor, of the engine speed, of the transmission coefficient, of the number of moles, and of the pressure in the combustion chamber.

27. The device according to claim 23 wherein said fifth means comprise:

an adder block for adding said first, second and third contributions; and an integrator block for integrating said first, second and third contributions.

28. The device of claim 19 wherein a difference between said pressure determined based on said mathematical-physical model and an actual pressure is less than 5%.

29. A method for determining a pressure in a combustion chamber of an internal combustion engine, the method comprising:

determining a first contribution due to compression and expansion of a fuel-air mixture inside a cylinder by a piston;

determining a second contribution due to the chemical reaction of combustion of the fuel-air mixture;

determining and using a third contribution due to heat losses through walls of the cylinder during said combustion; and determining the pressure in the combustion chamber as a function of said first, second, and third contributions.

30. The method of claim 29 wherein a difference between said determined pressure and an actual pressure is less than 5%.

31. The method of claim 29 wherein determining the pressure includes determining the pressure based on engine speed and quantity of fuel injected.

32. A device for determining a pressure inside a chamber of an internal combustion engine, the device comprising:

a virtual pressure sensor external to the combustion chamber, able to calculate in real time, the pressure in the combustion chamber using quantities including:

angular position of an engine shaft, speed of the engine, start of injection, and quantity of fuel injected per engine cycle, the virtual pressure sensor further being able to determine a contribution to pressure variation due to heat loss during fuel combustion.

33. The device of claim 32, further comprising a processor to select a suitable injection law to be applied in a next engine cycle.

34. The device of claim 33, further comprising a control unit coupled to the engine to control fuel injected into a cylinder based on the calculated pressure.

35. The device of claim 32 wherein a difference between said calculated pressure and an actual pressure is less than 5%.

* * * * *